US005338283A

United States Patent [19]

Fleming et al.

[11] Patent Number: 5,338,283

[45] Date of Patent: Aug. 16, 1994

[54] CENTRIFUGE ROTOR IDENTIFICATION SYSTEM

[75] Inventors: John A. Fleming, Newtown; Edward A. Kakos, Norwalk, both of Conn.

[73] Assignee: E. I. Du Pont de Nemours and Company, Wilmington, Del.

[21] Appl. No.: 958,996

[22] Filed: Oct. 9, 1992

[51] Int. Cl.[5] ..... B04B 15/00

[52] U.S. Cl. ..... 494/10; 340/671

[58] Field of Search ..... 494/9, 10, 11; 318/254; 340/671, 681, 870.34; 388/809, 907.5, 912, 933, 814, 811

[56] References Cited

U.S. PATENT DOCUMENTS

| | | | |
|---|---|---|---|
| 3,522,535 | 8/1970 | Adams | 340/671 |
| 3,599,002 | 8/1971 | Beutelspachel et al. | 494/10 |
| 3,746,247 | 7/1973 | Camilliere | 233/1 B |
| 4,205,261 | 5/1980 | Franklin | 318/480 |
| 4,257,040 | 3/1981 | Shirasaki et al. | 340/671 |
| 4,551,715 | 11/1985 | Durbin | 340/671 |
| 4,601,696 | 7/1986 | Kamm | 494/10 |
| 4,663,601 | 5/1987 | Troutman et al. | 335/207 |
| 4,700,117 | 10/1987 | Giebeler et al. | 318/327 |
| 4,772,254 | 9/1988 | Grassi et al. | 494/10 |
| 4,827,197 | 5/1989 | Giebeler | 318/3 |
| 4,849,917 | 7/1989 | Danielsson | 340/671 |
| 4,857,811 | 8/1989 | Barrett et al. | 318/3 |
| 4,960,406 | 10/1990 | Gorodissky et al. | 494/9 |
| 5,037,371 | 8/1991 | Romanauskas | 494/10 |

FOREIGN PATENT DOCUMENTS

| | | |
|---|---|---|
| 2559343 | 10/1983 | Fed. Rep. of Germany . |
| 2568377 | 1/1986 | France . |

*Primary Examiner*—Timothy F. Simone
*Assistant Examiner*—Reginald L. Alexander

[57] ABSTRACT

The present invention is directed to a rotor identification system operable to identify each of a plurality of $2^N$ rotors. Each rotor has at least two synchronizing detectable elements thereon and up to N additional identifying detectable elements. The identification system comprises a first and a second detector, each detector being operative to generate a synchronizing signal upon the passage of a synchronizing detectable element in proximity thereto; and means responsive to the substantially simultaneous generation of a synchronizing signal from each of the first and second detectors for generating an identification enabling signal. Rotor identification signal generating means responsive to the identification enabling signal is provided for generating a rotor identification signal in accordance with the number of identifying detectable elements provided on the rotor.

34 Claims, 1 Drawing Sheet

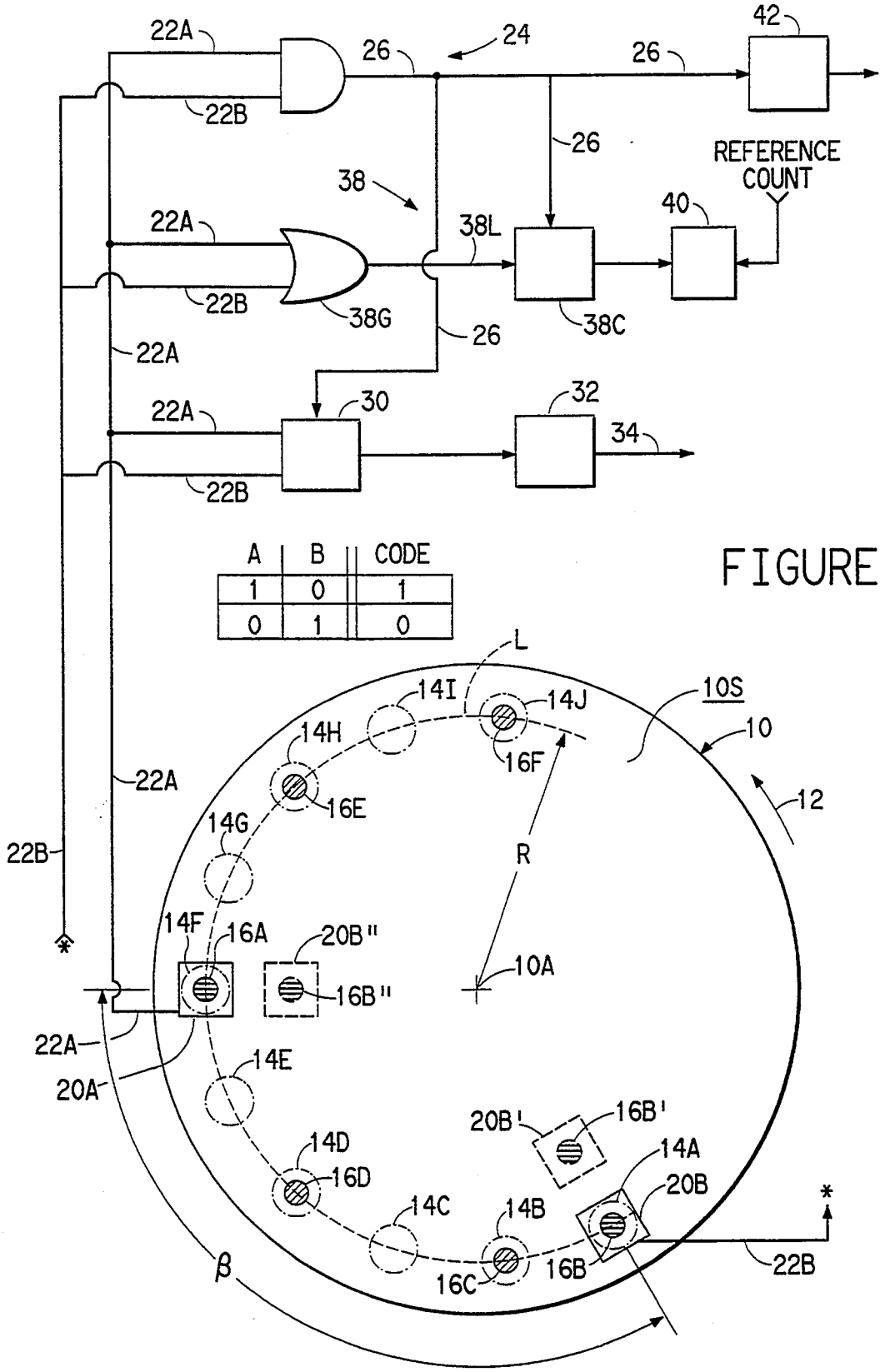
| A | B | CODE |
|---|---|---|
| 1 | 0 | 1 |
| 0 | 1 | 0 |
FIGURE

CENTRIFUGE ROTOR IDENTIFICATION SYSTEM

BACKGROUND OF THE INVENTION

1. Field of the Invention

The present invention relates to a rotor identification system for a centrifuge instrument.

2. Description of the Prior Art

A centrifuge instrument is a device by which a sample of a liquid is exposed to a centrifugal force field. The sample is carried within a centrifuge rotor. The rotor is mounted at the top of a rotatable shaft that is connected to a source of motive energy.

A centrifuge instrument may accept any one of a plurality of different centrifuge rotors, depending upon the separation protocol being performed. Accordingly, for both speed and temperature control considerations, it is advantageous to be able to ascertain the identity of the particular rotor mounted within the instrument during a given run. Such rotor identification information is further advantageous from a safety standpoint, since access to such information prevents operation of the rotor at a speed in excess of the rotor's maximum design speed or at an energy level in excess of the maximum containment energy of the instrument.

Various rotor identification arrangements are known. U.S. Pat. No. 5,037,371 (Romanauskas), assigned to the assignee of the present invention, discloses and claims a rotor recognition system that utilizes an ultrasonic transmitter and receiver to interrogate a rotor mounted within the instrument and to generate a rotor identification signal. With this arrangement the rotor itself does not carry any identifying indicia, aside from the identification information inherently present in its shape.

Other rotor identification systems modify each rotor used in the instrument to the extent that one or more detectable elements are disposed in some predetermined position on the body of the rotor. In some rotor identification systems the detectable elements take the form of individual magnets arranged in a predetermined pattern on the rotor. Magnetically responsive detectors are mounted in appropriate corresponding positions in the instrument. U.S. Pat. No. 4,772,254 (Grassl) exemplifies this class of identification system. In other rotor identification systems a coded disc having a pattern of alternating light reflective and light absorptive regions is attached to the rotor. Each reflective or absorptive region defines a detectable element. Corresponding optical transmitter/receiver devices are appropriately positioned within the instrument. U.S. Pat. No. 4,205,261 (Franklin) exemplifies this class of identification system.

In either class of identification system the identity of a given rotor may be based either upon the angular distance (with respect to the axis of rotor rotation) between two selected detectable elements or upon the number and/or type (e.g., polarity, reflectivity) of detectable elements passing a given detector during a predetermined time period. However, each basis in which rotor identity is determined is believed to exhibit attendant disadvantages.

In a rotor identification system that depends upon the angular distance between detectable elements it is possible that two rotors may have the same maximum speed and the same included angle. However, the rotors may have different optimum control parameters for speed and/or temperature and different kinetic energy levels at top speed. It would therefore be advantageous if each rotor was able to be uniquely identified.

In a rotor identification system that depends on the number and/or type of detectable elements on the rotor, a missing detectable element or a malfunctioning detector may result in a rotor mis-identification. This could result in non-optimum speed and/or temperature control parameters or even a safety hazard if the rotor is permitted to exceed either its design speed or the containment energy level of the centrifuge containment system. A malfunctioning sensing detector can also lead to these same problems.

In view of the foregoing it is believed advantageous to provide a rotor identification system that avoids the possibility of such rotor mis-identification and the effects of sensor malfunction.

SUMMARY OF THE INVENTION

The present invention is directed to a rotor identification system operable to identify each of a plurality of centrifuge rotors. Each rotor has at least two synchronizing detectable elements disposed thereon and up to N additional identifying detectable elements. The synchronizing detectable elements are arranged in a predetermined relationship with respect to each other and with the axis of rotation. The identification system comprises a first and a second detector, each detector also being arranged in the same predetermined relationship with respect to each other and with the axis of rotation. Each detector is operative to generate a signal upon the passage of a detectable element in proximity thereto. The system further comprises means responsive to the substantially simultaneous generation of a signal from each of the first and second detectors for generating a synchronizing signal. The synchronizing detectable elements and the detectors may be disposed the same radial distance or different radial distances from the axis of rotation. Alternatively or additionally, the synchronizing detectable elements and the detectors may be spaced about the axis of rotation a predetermined angular distance $\beta$ apart. The angular distance $\beta$ is preferably less than one hundred eighty degrees.

The system may further include a counter, preferably responsive to the generation of a synchronizing signal, for counting each signal generated from at least one of the detectors in response to the passage of any detectable element in proximity thereto. A comparator may be provided to compare the count produced by the counter to a predetermined reference count.

In the preferred case the identifying detectable elements are disposed about the axis of rotation so that no two identifying detectable elements are spaced the predetermined angular distance $\beta$ apart. The system further includes coding means responsive to a signal generated from one of the detectors upon the passage of an identifying detectable element in proximity thereto for generating a signal representative of a first binary digit and responsive to a signal generated from other of the detectors upon the passage of an identifying detectable element in proximity thereto for generating a signal representative of a second binary digit. Means responsive to at least one signal representative of a binary digit generating by the coding means is provided for generating a signal representative of the identity of a rotor.

In another aspect the present invention is directed to a centrifuge rotor rotatable about an axis of rotation, the rotor having at least two synchronizing detectable elements and up to N additional identifying detectable elements thereon. The synchronizing detectable elements are arranged on the rotor in the same predetermined relationship with respect to each other and with the axis of rotation as the detectors are disposed within the centrifuge instrument. In the preferred instance the synchronizing detectable elements are spaced apart about the axis of rotation a predetermined angular distance $\beta$ (preferably less than one hundred eighty degrees). Additionally or alternatively, the synchronizing detectable elements may be disposed the same or different radial distances from the axis of rotation.

The identifying detectable elements are disposed about the axis of rotation so that no two identifying detectable elements are spaced the predetermined angular distance $\beta$ apart. In the preferred instance some of the identifying detectable elements are disposed between the first and the second synchronizing detectable elements in the direction of rotation and others of the identifying detectable elements are disposed between the second and the first synchronizing detectable elements in the direction of rotation.

BRIEF DESCRIPTION OF THE DRAWINGS

The invention will be more fully understood from the following detailed description, taken in connection with the accompanying drawing, which forms a part of this application and in which the sole FIGURE is a bottom plan view illustrating the arrangement of detectable elements on a rotor and the location of cooperating detectors within the centrifuge instrument.

DETAILED DESCRIPTION OF THE DRAWINGS

With reference to the FIGURE shown is a portion of any surface 10S of any one of a family of centrifuge rotors 10 able to be received within a centrifuge instrument. The rotor 10 is rotatable in a direction 12 about an axis of rotation 10A. The surface 10S has a predetermined plurality of sites 14A through 14J thereon. Each site 14A through 14J is indicated by a dot-dash circle. Any convenient number of sites 14 may be provided. As will be discussed more fully herein each of the sites 14A through 14J defines a possible location at which a detectable element 16 may be attached to the rotor 10. In the FIGURE six such detectable elements 16A through 16F are mounted to the rotor at respective sites 14F, 14A, 14B, 14D, 14H and 14J.

The detectable elements 16A and 16B (located at the sites 14F, 14A, respectively) are termed "synchronizing detectable elements" and are indicated in the FIGURE by double cross hatching. The remaining detectable elements 16C through 16F are termed "identifying detectable elements" and are indicated in the FIGURE by diagonal hatching. To implement the identification system of the present invention it is required that at least two synchronizing detectable elements 16A, 16B and from zero up to (and including) N additional identifying detectable elements 16C through 16F be deployed on the rotor 10. In the example illustrated in the FIGURE the number N equals four, but any convenient number of identifying detectable elements may be deployed. The purpose of the synchronizing detectable elements and the identifying detectable elements will be discussed hereinafter.

Also superimposed in the FIGURE are the locations (with respect to each other and to the axis of rotation 10A) within the instrument at which are disposed a respective first and a second detector 20A, 20B. The detectors 20A, 20B are mounted within the instrument in any convenient fashion. Each of the detectors 20A, 20B is responsive to the passage of a detectable element in proximity thereto to generate an output signal, or pulse. The output from each of the detectors 20A, 20B is carried by a respective line 22A, 22B.

In accordance with this invention the synchronizing detectable elements 16A, 16B and the additional identifying detectable elements 16C through 16F are arranged in a predetermined positional relationship with respect to each other and with respect to the axis of rotation 10A. Moreover, the detectors 20A, 20B are also arranged in the same predetermined positional relationship with respect to each other and to the axis of rotation 10A.

The preferred positional relationship at which the synchronizing detectable elements 16 and the detectors 20A, 20B are arranged within the instrument is shown in solid lines in the Figure. With regard to the synchronizing detectable elements 16A and 16B, in the preferred case these elements 16A, 16B are disposed the same radial distance R from the axis of rotation 10A and are spaced apart about the axis of rotation 10A at a predetermined angular distance $\beta$. The angular distance $\beta$ is preferably less than one hundred eighty degrees. The detectors 20A, 20B are conformally spaced from and about the axis of rotation at the substantially the same radial distance R and at the same predetermined angular distance $\beta$. As will be discussed herein the synchronizing detectable elements and the detectors may occupy other positional relationships.

The preferred positional relationship of the identifying detectable elements 16C through 16F also is shown in solid lines in the Figure. The identifying detectable elements 16C through 16F are located at the same radial distance R from the axis 10A as are the synchronizing detectable elements 16A, 16B. However, the identifying detectable elements 16C through 16F are disposed angularly about the axis 10A so that no two identifying detectable elements are spaced the predetermined angular distance $\beta$ apart.

In operation, owing to the above-described positional relationships among the synchronizing detectable elements 16A, 16B, the detectors 20A, 20B, and the identifying detectable elements 16C through 16F, upon rotation of the rotor 10 in the direction of the arrow 12 only the two synchronizing detectable elements 16A, 16B substantially simultaneously pass proximally to a respective one of the detectors 20A, 20B. As will be developed this circumstance permits the generation of a unique synchronization signal during each revolution of the rotor 10.

As noted earlier each of the detectors 20A, 20B is operative to generate a pulse upon the passage of a detectable element in proximity thereto. Accordingly, as the synchronizing detectable elements 16A, 16B substantially simultaneously pass in proximity to a respective detector 20A, 20B, the pulse so produced from each is carried on the lines 22A, 22B to a synchronizing signal generating means 24. The synchronizing signal generating means 24, functionally indicated in the Figure by the logic symbol AND, responds to the substantially simultaneous generation of a signal from each of the first and second detectors 20A, 20B to generate a synchronizing signal on a line 26. In accordance with this invention the synchronizing signal on the line 26 is generated only when both of the synchronizing detectable elements 16A, 16B substantially simultaneously pass in proximity to a respective detector 20A, 20B.

The identifying detectable elements 16C through 16F are used to generate rotor identification information from which the identity of the rotor 10 may be ascertained. Accordingly, each of the detectors 20A, 20B is connected over the line 22A, 22B to a coding arrangement generally indicated by the character 30. The coding arrangement 30 makes use of the fact that, in accordance with the preferred embodiment of the present invention, the identifying detectable elements 16C through 16F are arranged on the rotor 10 so that no two of these elements are spaced apart by the predetermined angular distance $\beta$.

Each detector 20A, 20B produces an output pulse when an identifying detectable element 16C through 16F passes proximally thereto. The coding arrangement 30 is enabled by the synchronizing signal on the line 26. Generally speaking, the coding arrangement 30 is responsive to a pulse generated from one of the detectors upon the passage of an identifying detectable element in proximity thereto to generate a signal representative of a first binary digit and to a pulse generated from other of the detectors upon the passage of an identifying detectable element in proximity thereto to generate a signal representative of a second binary digit.

The logical operation of the coding arrangement 30 may be more clearly understood from the truth table shown in the Figure. The production of a pulse from the detector 20A coupled with the simultaneous absence of a pulse from the other detector 20B is coded to a binary "1". Conversely, the production of a pulse from the detector 20B coupled with the simultaneous absence of a pulse from the other detector 20A is coded to a binary "0". Rotor identification means 32 connected to the output of the coding means 30 may be used to decipher one or more of the coded signal(s) output from the coding arrangement 30 to produce a rotor identification signal on the line 34.

Each of the detectors 20A, 20B produces an output pulse when either a synchronizing detectable element 16A, 16B or an identifying detectable element 16C through 16F passes proximally thereto. In the preferred embodiment each of the detectors 20A, 20B is also connected to a counting arrangement generally indicated by the character 38. The counting arrangement 38, indicated in the Figure by the logic symbol OR 38G and the counter 38C connected at its output, is also enabled in response to the synchronizing signal on the line 26. The logic of the counting arrangement 38 is arranged to produce a count pulse on the line 38L which triggers the counter 38C thereby to produce a count of the total number of pulses produced by each of the detectors 20A, 20B in response to the passage of any detectable element in proximity thereto. The counter 38C may be connected to a comparator 40 having that has a predetermined reference count applied thereto.

It should be understood that the functions provided by the synchronizing signal generating means 24, the coding means 28, the counting means 38, and the comparator 40 may be implemented using any convenient combination of discrete and programmable components. The manner in which the foregoing features of the present invention may be used to configure one form of microprocessor-based computer controlled implementation of a rotor identification system is now set forth. In the implementation discussed, the detectable elements 16A through 16F are realized using magnets of a polarity appropriate to trigger a pulse from each of a Hall-effect sensor used as the detectors 20A, 20B; the synchronizing signal generating means 24 is realized using an integrated logic NOR gate responsive to the signals on the lines 22A, 22B (to provide the logic function AND); and the counting arrangement 38 includes an integrated logic NAND gate (to provide the logic function OR) to produce a pulse in response to these same signals.

Using an input latch the appropriately programmed microprocessor reads the signals on the lines 22A, 22B from the respective detectors 20A, 20B, the synchronizing signal on the line 26 (from the NOR gate), and the count pulse on the line 38L (from the NAND gate).

Initially a diagnostic phase of operation is implemented. The microprocessor looks for any pulse store in the latch that is received on the lines 22A, 22B. If no pulse is detected after a predetermined time period, a first diagnostic error is generated and rotor identification is prohibited. If pulses are detected, the microprocessor looks for the beginning of a synchronizing signal (e.g., a low to high voltage signal) on the line 26 from from the NOR gate. If the leading edge of the synchronizing signal is not detected after a predetermined time, a second diagnostic error is generated and rotor identification is prohibited. Assuming the leading edge of the synchronizing signal is detected, the trailing edge of this signal is used by the microprocessor to clear an internal counting register. The microprocessor, in response to the synchronizing signal on the line 26 from the NOR gate, counts the pulses received from the NAND gate and stores the count in the register. If a predetermined number of counts is not detected, a third diagnostic error is generated and identification is precluded. In the system hereinabove described, an appropriate reference count detected between synchronizing signals would be either ten or eleven (depending upon the simultaneity of the passage of the synchronizing magnets past the detectors). If the appropriate count is not received, another diagnostic error signal is generated, and rotor identification is prohibited.

Assuming the appropriate diagnostic count has been detected, the next occurrence of the synchronizing signal causes the microprocessor to enter the rotor recognition phase of operation. Further count pulses are ignored. During this phase the signals from the detectors are used to determine a four binary digit rotor code. This code is compared to a stored library of codes, and a rotor identity signal is generated.

For the particular rotor shown in the Figure, assuming that the output of the detectors is normally logic "1" ("high" voltage), the sequence of pulses produced from each detector 20A, 20B during one revolution following a synchronizing signal is as follows:

| | | | | |
|---|---|---|---|---|
| 20A/22A: | 1 | 0 | 1 | 0 |
| 20B/22B: | 0 | 1 | 0 | 1 |

Using the truth table for the coding means 30 shown in the Figure, this pattern will produce a rotor code "1 0 1 0". Preferably, the identification is repeated a predetermined number of time before a positive identification is made. If a different rotor identity is determined during any iteration an error is generated. The identification of the rotor may also be compared with an operator-input rotor identification, if desired.

If desired, since the synchronizing signal occurs once every rotor revolution, the line 26 may also be applied to a counter 42 (see Figure), thereby to serve a tachometer function.

As noted, in the preferred instance the detectable elements are implemented using magnets suitably attached to the rotor 10 and the detectors 20A, 20B are, accordingly, magnetically responsive devices, such as Hall Effect sensors. The magnets are affixed with the appropriate pole presented to the sensor. It should be understood, of course, that the detectable elements may be implemented using light reflective or light absorptive regions, in which event the detectors 20A, 20B will be correspondingly implemented from paired light source/light receiving devices.

In the FIGURE the sites 14 at which the detectable elements 16 are located lie on a generally circular locus L (indicated by a dashed line) having a radius R from the axis of rotation 10A. The detectors 20A, 20B are correspondingly located at an operative position within the instrument. This "single track" implementation is preferred because the single track arrangement avoids any problems of possible crosstalk occurring when multiple radial tracks must be fit into a limited radial space and minimizes the number of detectable elements and detectors that is required. However, if desired, it should be appreciated that the invention may be implemented using two (or more) concentric tracks of detectable elements and correspondingly arranged detectors, so long as the synchronizing signal is generated by the substantially simultaneous passage of each synchronizing detectable element in proximity to one of the detectors. As one example of such an implementation the angular spacing $\beta$ may be maintained, but with one of the synchronizing detectable elements (e.g., the element 16B') and one of the detectors (e.g., the detector 20B') (both indicated in dashed lines) being disposed closer to the axis of rotation 10A (i.e., on a radially inner track). As an alternative example one of the synchronizing detectable elements (e.g., the element 16B'') and one of the detectors (e.g., the detector 20B'') may again be disposed on a radially inner track, but with both of the synchronizing detectable elements 16A, 16B'' and both of the detectors 20A, 20B'' lying at the same angular position with respect to the axis of rotation (i.e., the angular spacing $\beta$ therebetween is zero degrees). This alternative is also indicated in the FIGURE. In either event any convenient number of identifying detectable elements may be located on the inner track(s) in any convenient desired disposition.

The identifying detectable 16C through 16F may be arranged with respect to the synchronizing detectable elements in any convenient fashion. In the FIGURE some of the identifying detectable elements (i.e., the elements 16C, 16D) are disposed in the region between the synchronizing detectable elements 16A, 16B (in the direction of rotation 12) while others of the identifying detectable elements (i.e., the elements 16E, 16F) are disposed in the region between the synchronizing detectable 16B, 16A (again with reference to the direction of rotation 12). If desired, all of the identifying detectable elements may be disposed in one such region or the other. Additionally or alternatively, the identifying detectable elements may be disposed on one or more radial tracks. Of course, for considerations of rotor balancing it may be necessary or desirable to provide suitable masses at locations on the rotor to counterbalance the presence of the synchronizing and identifying detectable elements, wherever these elements are positioned. It should also be noted that although the detectable elements 16A through 16F are believed to be most conveniently disposed on the undersurface of the rotor 10, the present invention is not limited thereto. Any suitable surface of the rotor 10 may be used, with the detectors 20A, 20B being correspondingly operatively located.

As should be clear from the foregoing the number N of identifying detectable elements determines how many unique rotor identifications are possible with the rotor identification system of the present invention. In the Figure, the four additional identifying detectable elements (16C through 16F) are provided on the rotor and are coded such that the possible population of rotors that may be distinguished using the system of the present invention is $2^N$, or sixteen. Any convenient number N may be selected and any other suitable coding system may be used.

It should be apparent from the foregoing that with the identification system in accordance with the present invention any detector malfunction such as to always indicate the presence of a synchronizing detectable element or such as to always show the absence of a synchronizing detectable element results in non-identification not a mis-identification. The system may be configured so that any reading is discarded, a warning generated, or the drive disable, as the needs of the centrifuge system dictate. The identification system of the present invention is not dependent on angular position, only on the generation of the synchronizing signal in response to the substantially simultaneous passage of the synchronizing elements in proximity of the detectors. Any uniform or non-uniform spacing may be used, so long as practical considerations for placement and non-ambiguous detection are met.

Those skilled in the art, having the benefit of the teachings of the present invention, may effect numerous modifications thereto. Such modifications are to be construed as lying within the contemplation of the present invention, as defined by the appended claims.

What is claimed is:

1. A rotor identification system operable to identify each of a plurality of centrifuge rotors as the same is rotated about an axis of rotation, each rotor having at least two synchronizing detectable elements and up to a number N identifying detectable elements thereon, the synchronizing detectable elements being arranged in a predetermined relationship with respect to each other and with the axis of rotation, the system comprising:

a first and a second detector, the detectors also being arranged in the same predetermined relationship with respect to each other and with the axis of rotation, each detector being operative to generate a signal upon the passage of a detectable element in proximity thereto; and means responsive to the substantially simultaneous generation of a signal from both of the first and second detectors produced by the substantially simultaneous passage of each of the synchronizing detectable elements in proximity to a respective detector for generating a synchronizing signal.

2. The system of claim 1 wherein the synchronizing detectable elements are spaced about the axis of rotation a predetermined angular distance $\beta$ apart, and wherein the detectors are also spaced about the axis of rotation the predetermined angular distance $\beta$ apart.

3. The system of claim 2 wherein the predetermined angular distance $\beta$ is less than one hundred eighty degrees.

4. The system of claim 2 wherein the synchronizing detectable elements are disposed the same radial distance from the axis of rotation, and wherein the detectors are also disposed the same radial distance from the axis of rotation.

5. The system of claim 2 wherein the first synchronizing detectable element is disposed a first radial distance from the axis of rotation and the second synchronizing detectable element is disposed a second radial distance from the axis of rotation, and wherein the first detector is disposed the first radial distance from the axis of rotation and the second detector is disposed the second radial distance from the axis of rotation.

6. The system of claim 1 wherein the synchronizing detectable elements are disposed the same radial distance from the axis of rotation, and wherein the detectors are also disposed the same radial distance from the axis of rotation.

7. The system of claim 1 wherein the first synchronizing detectable element is disposed a first radial distance from the axis of rotation and the second synchronizing detectable element is disposed a second radial distance from the axis of rotation, and wherein the first detector is disposed the first radial distance from the axis of rotation and the second detector is disposed the second radial distance from the axis of rotation.

8. The system of claim 1 further comprising:

a counter for counting each signal generated by at least one of the detectors in response to the passage of a detectable element in proximity thereto.

9. The system of claim 1 further comprising:

a counter for counting each signal generated by at least one of the detectors in response to the passage of an identifying detectable element in proximity thereto.

10. The system of claim 1 further comprising:

a counter responsive to the synchronizing signal for counting each signal generated by at least one of the detectors in response to the passage of a detectable element in proximity thereto.

11. The system of claim 1 further comprising:

a counter responsive to the synchronizing signal for counting each signal generated by at least one of the detectors in response to the passage of an identifying detectable element in proximity thereto.

12. The system of claim 11 further comprising:

a comparator for comparing the count produced by the counter to a predetermined reference count.

13. The system of claim 10 further comprising:

a comparator for comparing the count produced by the counter to a predetermined reference count.

14. The system of claim 9 further comprising:

a comparator for comparing the count produced by the counter to a predetermined reference count.

15. The system of claim 4 wherein the identifying detectable elements are disposed about the axis of rotation so that no two identifying detectable elements are spaced the predetermined angular distance $\beta$ apart, the system further comprising:

coding means responsive to a signal generated from one of the detectors upon the passage of an identifying detectable element in proximity thereto for generating a signal representative of a first binary digit and responsive to a signal generated from other of the detectors upon the passage of an identifying detectable element in proximity thereto for generating a signal representative of a second binary digit.

16. The system of claim 3 wherein the identifying detectable elements are disposed about the axis of rotation so that no two identifying detectable elements are spaced the predetermine angular distance $\beta$ apart, the system further comprising:

coding means responsive to a signal generated from one of the detectors upon the passage of an identifying detectable element in proximity thereto for generating a signal representative of a first binary digit and responsive to a signal generated from other of the detectors upon the passage of an identifying detectable element in proximity thereto for generating a signal representative of a second binary digit.

17. The system of claim 2 wherein the identifying detectable elements are disposed about the axis of rotation so that no two identifying detectable elements are spaced the predetermined angular distance $\beta$ apart, the system further comprising:

coding means responsive to a pulse generated from one of the detectors upon the passage of an identifying detectable element in proximity thereto for generating a signal representative of a first binary digit and responsive to a pulse generated from other of the detectors upon the passage of an identifying detectable element in proximity thereto for generating a signal representative of a second binary digit.

18. The system of claim 17 further comprising:

means responsive to at least one signal representative of a binary digit generating by the coding means for generating a signal representative of the identity of a rotor.

19. The system of claim 16 further comprising:

means responsive to at least one signal representative of a binary digit generating by the coding means for generating a signal representative of the identity of a rotor.

20. The system of claim 15 further comprising:

means responsive to at least one signal representative of a binary digit generating by the coding means for generating a signal representative of the identity of a rotor.

21. A centrifuge rotor rotatable about an axis of rotation in an centrifuge instrument having at least a first and a second detector therein, the detectors being arranged in a predetermined relationship with respect to each other and with the axis of rotation, the rotor having a surface thereon with at least two synchronizing detectable elements being disposed on the surface, the rotor having up to a number N identifying detectable elements, wherein the synchronizing detectable elements are arranged on the surface of the rotor in the same predetermined relationship with respect to each other and with the axis of rotation.

22. The rotor of claim 21 wherein the detectors are spaced about the axis of rotation a predetermined angular distance $\beta$ apart, and wherein the synchronizing detectable elements are also spaced about the axis of rotation the predetermined angular distance $\beta$ apart.

23. The rotor of claim 22 wherein the predetermined angular distance $\beta$ is less than one hundred eighty degrees.

24. The rotor of claim 22 wherein the detectors are also disposed the same radial distance from the axis of rotation and wherein the synchronizing detectable elements are disposed the same radial distance from the axis of rotation.

25. The system of claim 22 wherein the first detector is disposed the first radial distance from the axis of rotation and the second detector is disposed the second radial distance from the axis of rotation radial distance from the axis of rotation, and wherein the first synchronizing detectable element is disposed a first radial distance from the axis of rotation and the second synchronizing detectable element is disposed a second radial distance from the axis of rotation.

26. The system of claim 24 wherein the identifying detectable elements are disposed about the axis of rotation so that no two identifying detectable elements are spaced the predetermined angular distance $\beta$ apart.

27. The system of claim 23 wherein the identifying detectable elements are disposed about the axis of rotation so that no two identifying detectable elements are spaced the predetermined angular distance $\beta$ apart.

28. The system of claim 22 wherein the identifying detectable elements are disposed about the axis of rotation so that no two identifying detectable elements are spaced the predetermined angular distance $\beta$ apart.

29. The rotor of claim 28 wherein some of the identifying detectable elements are disposed between the first and the second synchronizing detectable elements in the direction of rotation and wherein others of the identifying detectable elements are disposed between the second and the first synchronizing detectable elements in the direction of rotation.

30. The rotor of claim 27 wherein some of the identifying detectable elements are disposed between the first and the second synchronizing detectable elements in the direction of rotation and wherein others of the identifying detectable elements are disposed between the second and the first synchronizing detectable elements in the direction of rotation.

31. The rotor of claim 26 wherein some of the identifying detectable elements are disposed between the first and the second synchronizing detectable elements in the direction of rotation and wherein others of the identifying detectable elements are disposed between the second and the first synchronizing detectable elements in the direction of rotation.

32. The rotor of claim 21 wherein the detectors are disposed the same radial distance from the axis of rotation and wherein the synchronizing detectable elements are also disposed the same radial distance from the axis of rotation.

33. The rotor of claim 21 wherein the first detector is disposed the first radial distance from the axis of rotation and the second detector is disposed the second radial distance from the axis of rotation radial distance from the axis of rotation, and wherein the first synchronizing detectable element is disposed a first radial distance from the axis of rotation and the second synchronizing detectable element is disposed a second radial distance from the axis of rotation.

34. The rotor of claim 21 wherein some of the identifying detectable elements are disposed between the first and the second synchronizing detectable elements in the direction of rotation and wherein others of the identifying detectable elements are disposed between the second and the first synchronizing detectable elements in the direction of rotation.

* * * * *